US005673547A

United States Patent [19]

Baba et al.

[11] Patent Number: 5,673,547

[45] Date of Patent: Oct. 7, 1997

[54] METHOD OF AND APPARATUS FOR SPINNING AND PIECING YARN

[75] Inventors: Kenji Baba, Kyoto, Japan; Shinichi Satomi, Charlotte, N.C.; Yuji Imamura, Kyoto, Japan

[73] Assignee: Murata Kikai Kabushiki Kaisha, Kyoto, Japan

[21] Appl. No.: 522,718

[22] Filed: Sep. 1, 1995

[30] Foreign Application Priority Data

Sep. 5, 1994 [JP] Japan ..... 6-238445

[51] Int. Cl.[6] ..... D01H 11/00; D01H 13/04

[52] U.S. Cl. ..... 57/261; 57/279; 57/328; 57/333; 57/350

[58] Field of Search ..... 57/328, 350, 361, 57/279, 288, 333

[56] References Cited

U.S. PATENT DOCUMENTS

| | | | |
|---|---|---|---|
| 4,845,936 | 7/1989 | Artzt et al. | 57/261 |
| 5,146,740 | 9/1992 | Mori | 57/328 |
| 5,159,806 | 11/1992 | Mori et al. | 57/328 |
| 5,193,335 | 3/1993 | Mori | 57/328 |
| 5,211,001 | 5/1993 | Mori | 57/328 |
| 5,263,310 | 11/1993 | Mori | 57/328 |
| 5,419,110 | 5/1995 | Mikami et al. | 57/261 |
| 5,511,373 | 4/1996 | Banba | 57/328 |

FOREIGN PATENT DOCUMENTS

| | | | |
|---|---|---|---|
| 6-173129 | 6/1994 | Japan . | |
| 6-173130 | 6/1994 | Japan | 57/328 |
| 6-220728 | 8/1994 | Japan | 57/261 |
| 6-240520 | 8/1994 | Japan | 57/328 |
| 94/00626 | 1/1994 | WIPO | 57/328 |

*Primary Examiner*—William Stryjewski

*Attorney, Agent, or Firm*—Armstrong, Westerman, Hattori, McLeland & Naughton

[57] ABSTRACT

A spinning apparatus having a spinning section for forming yarn by applying a rotating air current of predetermined air pressure to a supplied fiber bundle and twisting the yarn while opening an end of the fiber bundle, and having a piecing section for reverse threading a spun yarn end into that spinning section. The spinning apparatus has a high pressure application member for applying high pressure air at a pressure higher than the aforementioned predetermined air pressure to such fiber bundle during the predetermined time after the spun yarn end is reverse threaded into the spinning section. The high pressure application member includes a first air circuit for supplying the aforementioned predetermined air pressure, a second air circuit that supplies air at a pressure higher than the aforementioned predetermined air pressure and a change-over member between the first and second air circuits.

6 Claims, 6 Drawing Sheets

RESTART OF SPINNING

PREVIOUSLY NORMAL PRESSURE AIR
t
t1

HIGH PRESSURE AIR
T
t
t3

NORMAL PRESSURE AIR
t
t2

OUTPUT AIR PRESSURE
t

METHOD OF AND APPARATUS FOR SPINNING AND PIECING YARN

FIELD OF THE INVENTION

This invention is related to a spinning apparatus having a spinning section that forms a yarn by applying a rotating air current to a non-twisted fiber bundle drafted by a draft apparatus and inserting a twist in the yarn while opening the aforementioned fiber bundle and having a piecing section which threads reversely the spun yarn end into that spinning section making spinning recommencement possible and, in particular, is related to a spinning method and the apparatus that is able to make the piecing, so that yarn strength of the joint part, when restarting spinning, is strong.

RELATED ART STATEMENT

Laid open patent Hei 6-173129 is recorded as an example of prior art of a spinning apparatus having a spinning section that forms spun yarn from a fiber bundle (sliver) and a piecing section, that threads reversely the spun yarn end, joints the yarn (known as "piecing" below) and enables recommencement of spinning.

This spinning apparatus is provided with a spinning section that blows air at a predetermined pressure from an air nozzle to a supplied fiber bundle and making use of the thus formed rotating air current, then opens the fiber bundle and forms a spun yarn by twisting this opened fiber bundle. Yarn spun by traditional air spinning apparatus twists fiber around the core yarn in such a way that it is called fastened spun yarn, but a high quality spun yarn very similar to a real twisted yarn by a ring spinning machine can be obtained at high speed from this spinning apparatus.

On this spinning section, spinning of a spun yarn by a spun yarn formation process, as in the case where fibers and impurities included in the fibers are jammed in the air nozzle and the like, is impossible. In this case, a process which extracts fibers etc., jammed in the air nozzle etc., is automatically executed and reverse threading of the package side yarn end after spinning, yarn joining and a piecing section that enables recommencement of spinning. Thus, spinning can be automatically restarted.

This piecing section comprises means for pulling out the spun yarn wound onto the package, means for reversely rotating the package, means for guiding the pulled out yarn and the yarn cuts, means for conveying the spun yarn to the spun yarn exit side of the spindle member separated from the nozzle member of the spinning section and means for opening or carries out conveyable yarn threading to the fiber bundle entrance side of the spindle member. In short, the end of the spun yarn is reversely threaded in the spinning section, the end is opened, a fiber bundle is supplied onto the end of the spun yarn, both are twisted together and the yarn is joined.

However, due to the combination of the spinning section and the piecing section, recommencement of spinning is possible but the strength of the piecing joint is insufficient and in some cases, the problem of a phenomenon called "slip out" where the joint breaks, when pulled, often occurs.

OBJECT AND SUMMARY OF THE INVENTION

In view of these kind of problems present in previous technology, it is an object of the present invention to propose a spinning method and apparatus which can carry out strong piecing of the joined part.

In a spinning apparatus of this invention, which solves the aforementioned problem, comprising a spinning section for applying a rotating air current of a predetermined air pressure on a supplied fiber bundle and for twisting, while opening the aforementioned fiber bundle, to form a yarn, and a piecing section that reversely threads a package side yarn end into the spinning section and makes possible recommencement of spinning, a high pressure application means, which increases the pressure of the aforementioned predetermined air pressure during a predetermined time period, after the aforementioned recommencement of spinning, is provided.

Also, it is preferable for the aforementioned high pressure application means to be composed of a first air circuit that supplies the aforementioned predetermined air pressure, a second air circuit that supplies air pressure higher than the aforementioned predetermined air pressure and a change-over means for that first and second air circuit.

Furthermore, it is preferable for the aforementioned change-over means to turn the second air circuit on before turning the first air circuit off.

Upon recommencement of spinning, the opened fiber of the package side yarn end becomes a parent yarn and it is necessary for this to be twisted together with the opened fibers of the newly supplied fiber bundle. However, the actions of the rotating air current are insufficient just after spinning recommencement and as the twist becomes insufficient. So, at the least during the predetermined time when the yarn joining part passes through the piecing section, the air pressure is risen and the actions of the rotating air current is increased. If a strong air current is continuously used on any part, except the yarn joining part, the yarn becomes too fastened. Thus, high pressure from the high pressure application means is limited to only that predetermined time when the yarn joining part is passing.

Furthermore, if the aforementioned high pressure application means is formed from the aforementioned first air circuit that supplies a predetermined air pressure, the aforementioned second air circuit that supplies air pressure higher than the predetermined air pressure and a change-over means for that first and second circuit, the change-over means can easily change the air pressure between the predetermined air pressure and high pressure.

Also, if the aforementioned change-over means turns the second air circuit on before turning the first air circuit off, the air is not interrupted when exchanging between high pressure air and predetermined air pressure.

DETAILED DESCRIPTION OF THE PREFERRED EMBODIMENT

Figure 3:
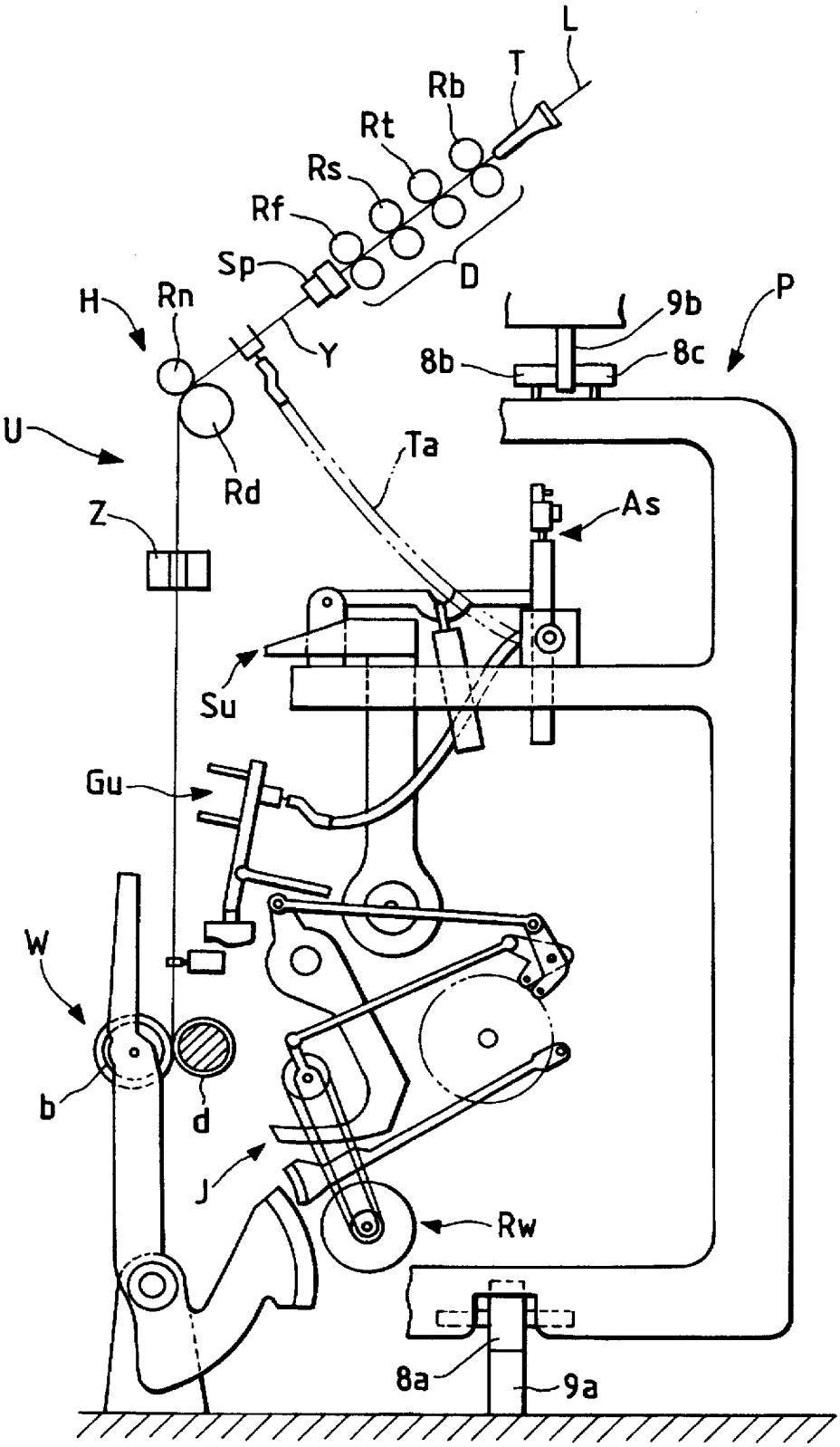
FIG. 3 is an outline diagram of an entire spinning machine including the piecing section.
Figure 4:
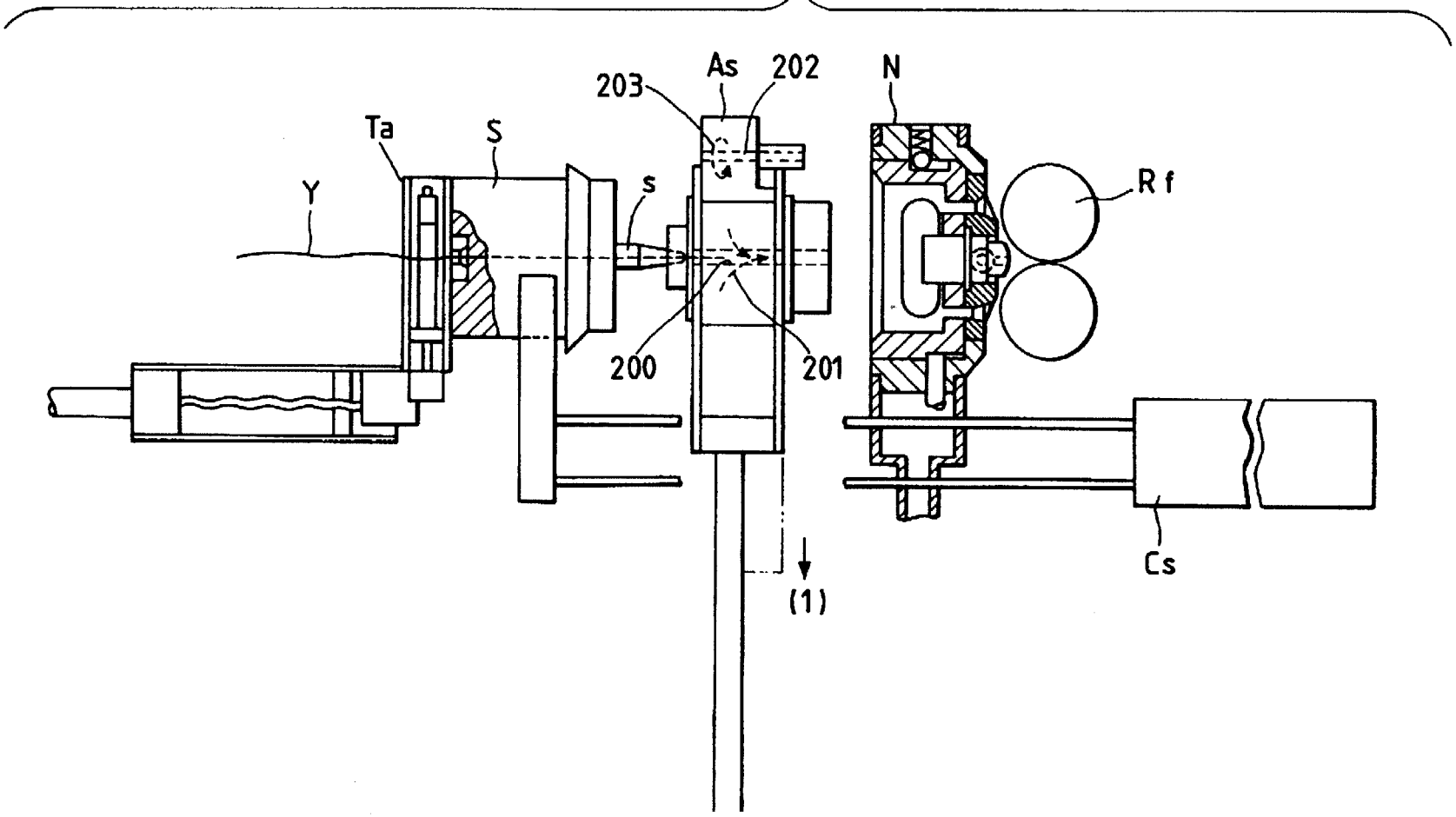
FIG. 4 is a sectional view, partially in section, showing reverse threading of a yarn end to the spinning section.
Figure 5:
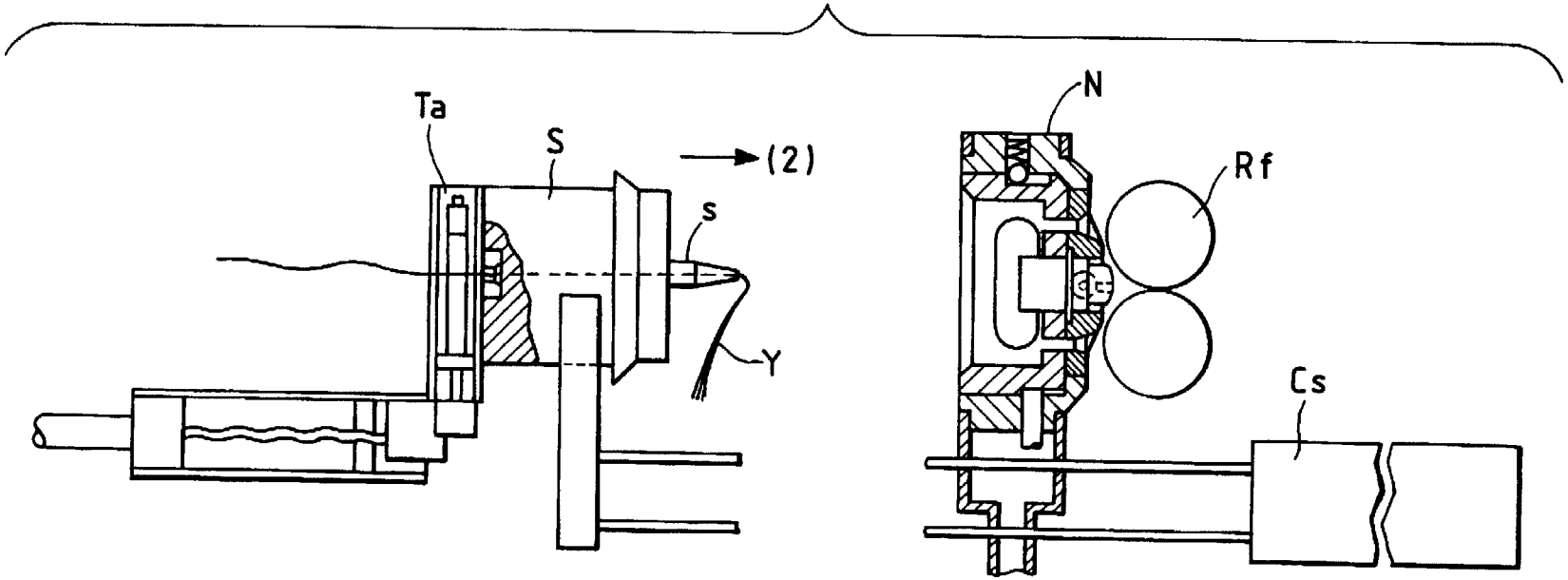
FIG. 5 is a sectional view, partially in section, showing reverse threading of the yarn end to the spinning section.

With reference to the drawings, embodiments of the present invention will be described. First of all, the entire spinning apparatus will be described with reference to FIG. 1 to FIG. 5 FIG. 1 is a sectional view, partially in section, showing a main structure of a spinning section of this invention. FIG. 2 is an expanded sectional view of the nozzle member of the spinning section. FIG. 3 is an outline diagram of an entire spinning machine including the piecing section and FIG. 4 and FIG. 5 are sectional views, partially in section, showing reverse threading of a yarn end to the spinning section.

Figure 1:
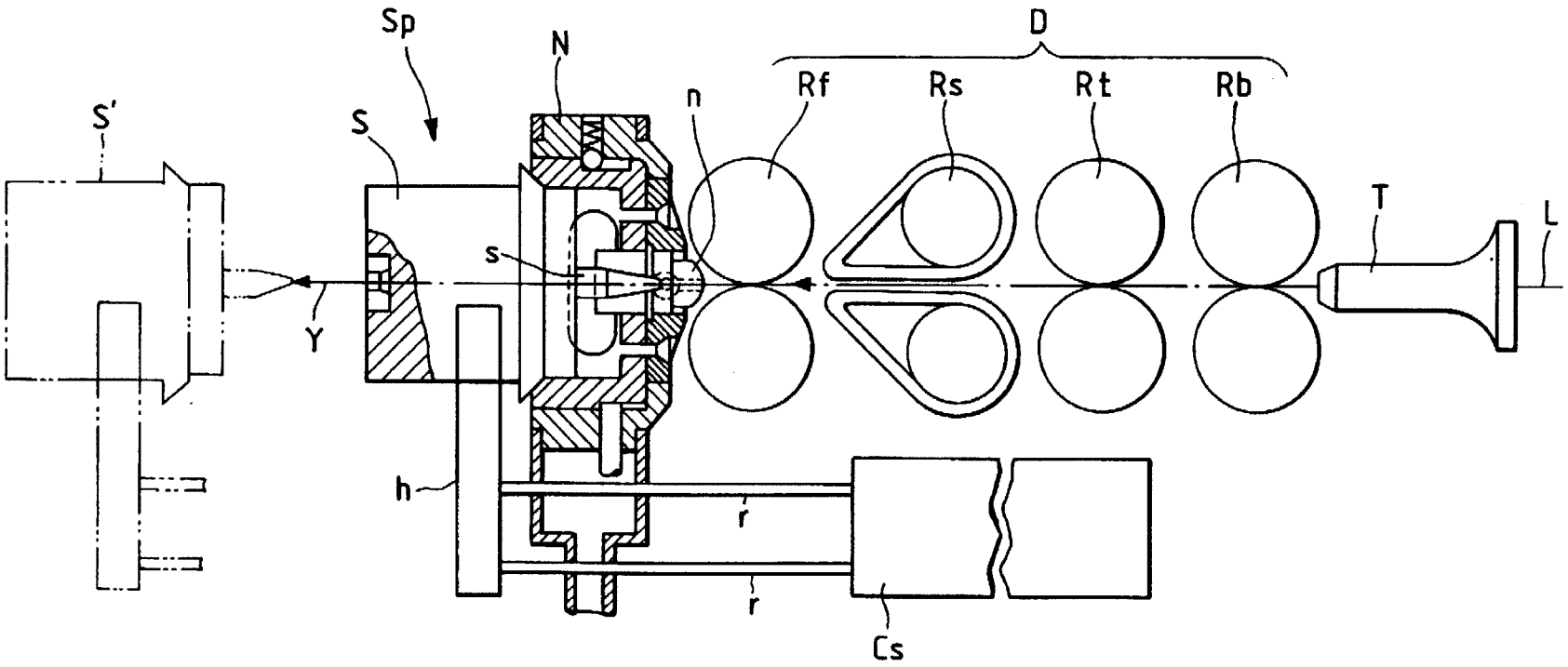
FIG. 1 is a sectional view, partially in section, showing a main structure of a spinning section of this invention.
Figure 2:
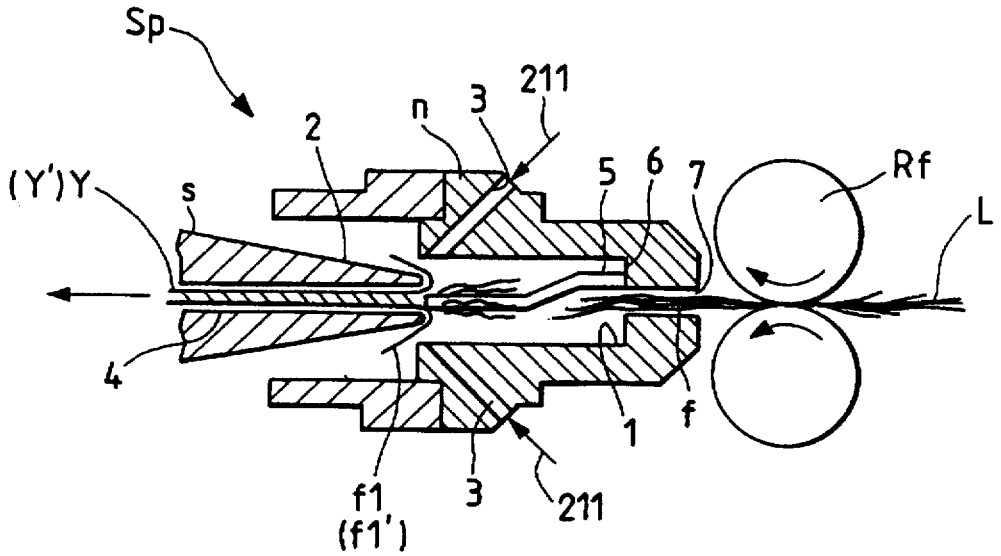
FIG. 2 is an expanded sectional view of a nozzle member of the spinning section.

Referring to FIGS. 1 and 2, the structure of the spinning section and the spinning process are described. In FIG. 1, the spinning section Sp comprises a nozzle member N and a spindle member S. D is a draft apparatus positioned upstream from the spinning section Sp which drafts a fiber bundle until it becomes fine. A sliver L is supplied to the draft apparatus D via a sliver guide T. This draft apparatus D comprises a back roller Rb, a third roller Rt, a second roller Rs having an apron and front roller Rf.

Further, on the draft apparatus D, the drafted sliver L is supplied to the spinning section Sp, comprising the nozzle member N and the spindle member S, and forms the spun yarn Y on the spinning section Sp. The spindle member S is maintained by a support member h on an end of rods r of a cylinder Cs and, as will be described later, is structured so as to be separable from the nozzle member N.

FIG. 2 is an expanded partial sectional view of the hollow spindle s of the spindle member S and the nozzle n of the nozzle member N shown in FIG. 1. There are four sloping air blowing holes 3 bored into the nozzle n and they point towards an end part 2 of a cone shaped hollow spindle s in the tangential direction of the circumference wall of a cylindrical hollow chamber 1. Also, a needle shaped guide member 5, having a diameter smaller than the diameter of the entrance part of the hollow passage 4 of the hollow spindle s, and positioned facing opposite the entrance part of the hollow passage 4, is attached to the front roller Rf side inside wall 6 of the nozzle n. Further, the hollow spindle s is supported so as to be rotatable by a suitable drive means, such as, an air turbine or drive belt (not shown) or, in the case of an unrotatable hollow spindle s, a twist nozzle that blows out a rotating air current into the spun yarn passage, is arranged near the entrance of the passage. Spinning is possible even with a non-rotatable hollow spindle with no re-arrangement of the twist nozzle.

The sliver L, which is supplied from the front roller Rf of the draft apparatus D, is sucked into the cylindrical hollow chamber 1 in the nozzle n by the sucking air current, near the sliver introduction hole 7 of the nozzle n, generated by the blowing air 211 from the air blowing holes 3. The fiber f, composing the sliver L sucked into the hollow chamber 1, is sent running along the outside of the needle shaped guide member 5 and, in the proximity of the cone-shaped end part 2 of the hollow spindle, the fiber fl is acted upon by the high speed rotating air current on the outer surface of the hollow spindle s blown from the air blowing holes, separates from the sliver L and, while spreading out, is twisted in the direction of the rotating air current.

At this time, the needle shaped guide 5 prevents construction of a core fiber and the spread out fiber fl, which is separated from the sliver L, is acted upon by the rotating air current and, as it is equally distributed around the outer surface of the hollow spindle s, there is virtually no core fiber. As a consequence, a twist is imparted in most of the fiber and a wound actual-twisted spun yarn Y is formed. Also, a false twist imparted by the rotating air current tends to travel in the direction of the front roller Rf, but that travel is prevented by the needle shaped guide 5 and consequently, there is no twisting of the sliver L by a false twist directly after it has been transported from the front roller Rf. As described above, the fiber fl, which have a twist imparted, are formed into a spun yarn Y, one after the other, and, after passing through the hollow passage 4 of the hollow spindle s, are sent in the direction of a spun yarn taking-up section.

Next, the piecing section of the spinning apparatus will be explained with FIGS. 3 to 5. In FIG. 3 which is a side view, the spinning apparatus has a plurality of spinning units U lined up. A piecing apparatus P runs along the longitudinal direction of the spinning apparatus and carries out yarn joining after detecting a spinning unit U where yarn breakage has occurred. 9*a* is a lower rail positioned on the floor F for the purpose of running, 8*a* is a wheel which runs on top of the lower rail 9*a* fixed to floor F and is rotationally driven by a suitable driving means, positioned on the piecing apparatus P. 9*b* is an upper rail positioned on the upper part of the spinning machine and 8*b* and 8*c* are wheel positioned on the upper part of the piecing apparatus P which sandwich upper rail 9*b*. The spinning unit U has an arrangement of the spinning section Sp adjacent to the above mentioned draft apparatus D. After the spun yarn Y, formed by this spinning section Sp, has passed a spun yarn delivery member H, consisting of a nip roller Rn, a delivery roller Rd and a slub catcher Z, such spun yarn Y is sent to a spun yarn taking-up section W and is wound on a package b.

In order for the spun yarn Y, wound onto the package b, to be wound off from this package b of the spinning unit U, where yarn breakage has occurred, the piecing section P separates the package b from a friction roller d. Also, the piecing apparatus P comprises a package push out member J in order to maintain the package b in the separated position, a package reverse rotating member Rw for rotating the package b separated from the friction roller d in the direction opposite to the winding direction, a guide member Su for pulling out the cut end of the spun yarn Y from the package b, a guide member Gu for guiding the spun yarn Y, pulled from the package b, and holding such spun yarn in a predetermined position, a transfer arm member Ta that holds the spun yarn Y, pulled from the package b, in the predetermined position and then conveys it to below the spindle member S of the spinning section Sp, an an air sucker member As for threading the spun yarn Y, pulled from the package b, onto the hollow spindle s of the spindle member S of the spinning section Sp and for opening the end of the threaded spun yarn Y.

Next, the yarn piecing operation by the piecing apparatus P will be explained. When yarn breakage is generated by the slub catcher Z of a spinning unit U, or due to the inside of the spinning section Sp, as shown in FIG. 1, first of all the rods r are extended, by the cylinder Cs of the spinning section Sp and the spindle S is separated from the nozzle member N and retracted to the position shown by the double dotted lines S', FIG. 1. Next, the piecing apparatus P carries out the following movements. In short, in FIG. 3, in order for the package push out member J to wind off spun yarn Y wound onto the package b of the spinning unit U, where yarn breakage has occurred, the piecing apparatus P separates the package b from the friction roller d and maintains the package b in the separated position. Next, the package reverse rotating member Rw rotates the package b, separated from the friction roller d, in the direction opposite to the winding direction. Next, the guide member Su pulls out the cut end of the spun yarn Y from the package b. Then the guide member Gu guides the spun yarn Y pulled from the package b and holds it in a predetermined position and, finally, the transfer arm member Ta cuts and holds the spun yarn Y pulled from the package b in the predetermined position and then conveys it to below the spindle member S of the spinning section Sp as shown by the double dotted line, FIG. 1.

Next, as shown in FIG. 4, the air sucker As, FIG. 3, is extended to the position as shown in FIG. 4, a yarn threading holes 200 is connected to the hollow spindle s of the spindle member S, a sucking air current 201 is generated inside the yarn threading hole 200 in the direction of the nozzle member N, as shown in the diagram, the package side spun yarn Y is sucked and yarn threading into the hollow spindle s occurs. The spun yarn Y is delivered from the package at the same time as generation of this sucking air current 201. When the spun yarn Y has emerged by a predetermined length from the end of the hollow spindle s, the delivery of the spun yarn Y is stopped and the generation of the sucking air current is stopped. Next, the air sucker member As is retracted to the position shown by the double dotted line arrow (1), FIG. 4, an untwisting pipe 202 is connected to the hollow spindle s, an air current (see arrow 203), rotating in the opposite direction to the twist direction of the spun yarn Y, is generated in the untwisting pipe 202 by the supplying of an air current from the periphery of that untwisting pipe 202, the end part of the spun yarn Y, which has emerged by a predetermined length from the end part of the hollow spindle s, is untwisted and the fiber forms a thinning end part. Then the air sucker member As is retracted to the standby position of FIG. 3. Due to this, the fiber on the end of the spun yarn Y assumes dn untwisted state. Next, the cylinder Cs is actuated, the rod r is retracted arrow (2), FIG. 5, and the spindle S is connected to the nozzle member N as shown in FIG. 1. At this point, the spun yarn Y is delivered from the package corresponding to the movement distance of the spindle S and the length of spun yarn Y protruding from the end of the hollow spindle S is supported at a predetermined length. Next, the spinning unit recommences the aforementioned spinning and yarn joining is carried out by a rotating air current of the following air current.

Figure 6:
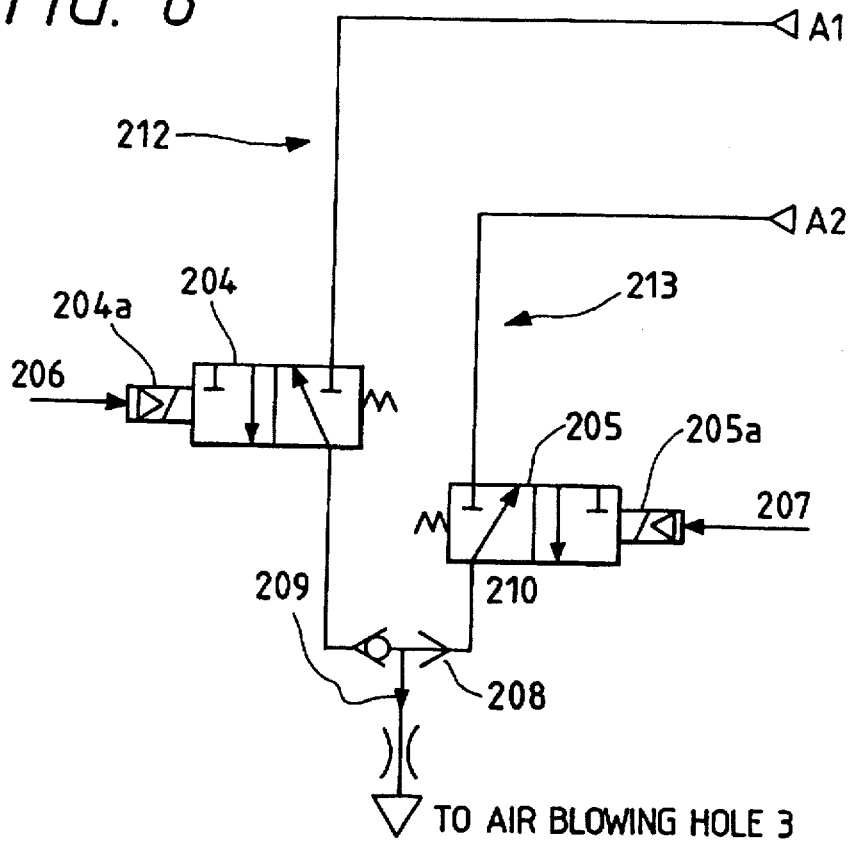
FIG. 6 is a wiring diagram showing a structure of circuits.
Figures 7A, 7B, 7C, 7D:
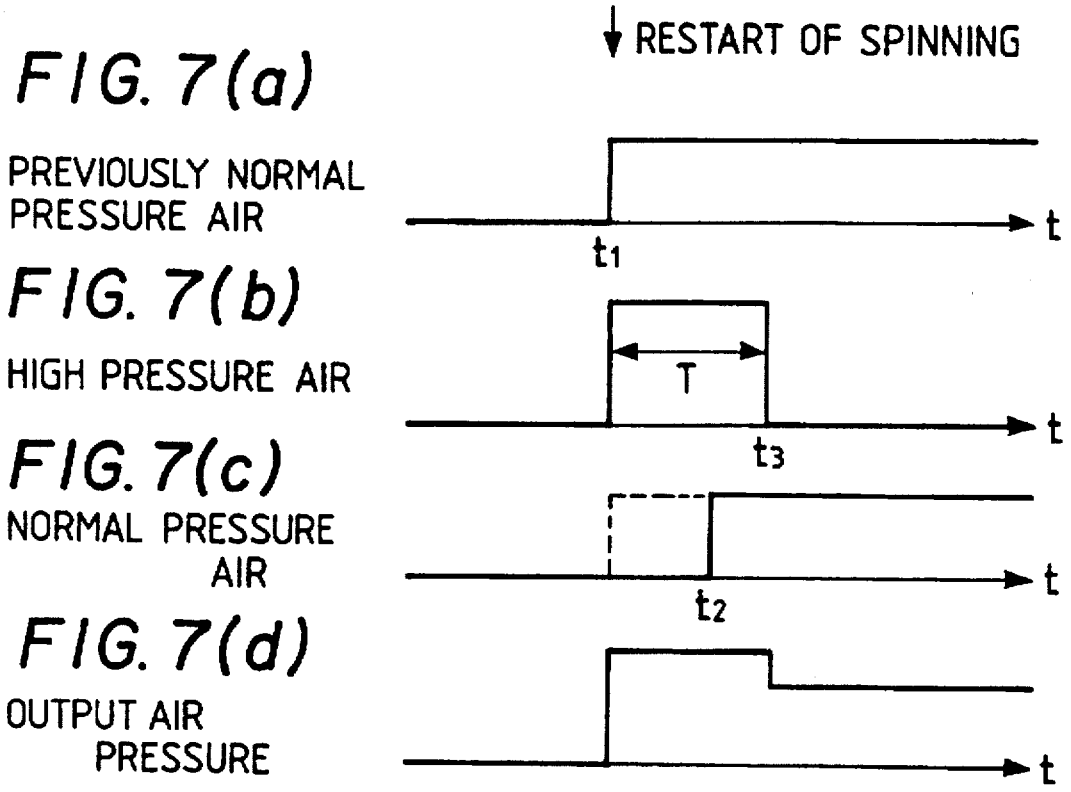
FIG. 7(*a*) is a graph showing air output, upon the restart of spinning, at previously normal air pressure.

Next, the air circuits and their actions will be explained by FIGS. 6 and 7 with respect to the nozzle member Sp of the present invention. FIG. 6 is a wiring diagram showing the structure of the air circuits and FIG. 7 is a graph showing the air output.

In FIG. 6, the air circuit includes a change-over valve 205 having a supply position which connects the primary and secondary side for supplying air and a cut-off position which not only cuts off the primary side but also connects the secondary side to the atmosphere, an arrangement of a predetermined pressure air circuit (first circuit) 213 which supplies air A2 at a predetermined pressure of between 3.5–5 $kg/cm^2$ and a change-over valve 204 with the same structure as the aforementioned change-over valve 205 and formed so that a high pressure air circuit (second circuit) 212, which supplies high pressure air A1 at 6–7 $kg/cm^2$ to the primary side of the shuttle valve 208 and the secondary side of the shuttle valve 208 is connected to the air blowing holes 3.

The air of the high pressure side takes precedence between the first circuit 213, which is the predetermined air pressure, and second circuit 212 which is high air pressure and the shuttle valve 208 supplies this to the air blowing holes 3. Also, change-over valves 204, 205 are made to open and close by magnetizing and demagnetizing upon instruction signals 206, 207 to magnetic coils 204*a*, 205*a*. The state shown in the diagram is such that both the high pressure air second circuit 212 and the predetermined pressure air first circuit 213 are in a cut-off state and air is not supplied to the blowing hole 3. Further, the instruction signals 206, 207 are signals where the activating signal of the draft apparatus D or the activating signal of the spun yarn delivery member H, formed from the nip roller Rn and the delivery roller Rd, are sent simultaneously or at roughly the same time. In summary, the start of spun yarn and the generation of the rotating air current is simultaneous.

This air circuit carries out the following operations when spinning recommences. When spinning is restarted, first of all the change-over valve 204 is magnetized by a signal 206 and changes to the supply position, high pressure air A1 is output via the shuttle valve 208, as shown by an arrow 209, and the shuttle valve 208 outputs this high pressure air A1 to the air blowing holes 3. Next, the change-over valve 205 is magnetized by signal 207 and changes to the supply position and predetermined air pressure A2 is output via the shuttle valve 208, as shown by an arrow 210, but the shuttle valve 208 still outputs high pressure air A1. After the change-over of the changing-over valve 204, a predetermined amount of time elapses and the changing-over 204 is demagnetized by a signal 206 and changes to the cut-off position. The shuttle valve 208 used for connecting the secondary side to the atmosphere is changed to the normal pressure air circuit side and supplies normal pressure air A2 to the air blowing holes 3. In this way, a high pressure air circuit 212 and a normal pressure air circuit 213 are arranged and, as they are changed-over, high pressure air can easily be output only for a predetermined time period.

This state will be explained with the use of FIGS. 7(*a*), 7(*b*), 7(*c*) and 7(*d*). In FIG. 7(*a*), when spinning recommences at time t1, high pressure air is applied from the high pressure air circuit (refer to symbol 209). Next in FIG. 7(*c*), predetermined pressure air is output from the predetermined pressure air circuit at time t2 (refer to symbol 210). At time t3 as shown in FIG. 7(*b*), after a predetermined amount of time T has passed after spinning has recommenced, the supply of high pressure air is stopped. This predetermined time T depends on the speed of spinning but is desirable within 10–500 ms until passing of the yarn joining part. Accordingly, as shown in FIG. 7(*a*), previously normal pressure air was out put (refer to 214) at the same time as spinning commencement. But in the present invention as shown in FIG. 7(*d*), high air pressure is output to the air blowing holes when high pressure air is precisely output (refer to symbol 211) after spinning recommencement only an extremely short time T. Moreover, when converting from high air pressure to predetermined air pressure, there is no interruption during output and due to this, yarn breakage does not occur.

In FIG. 2, at times of spinning recommencement, as a result of the air blown from the air blowing holes 3 (refer to arrow 211) being instantaneously maintained at a high pressure, the transition time for formation of a rotating air current is short and switch over to the fixed state is quick. Because of this, normally spun yarn Y is quickly continued and formed on the end of part Fl' of the pointed end of the yarn Y' which has been reversely threaded from the package so there is no "slip out" (where the yarn is tense but if pulled will break), the joint is clean and yarn joining piecing, with a high yarn strength maintenance rate, is carried out.

In short, when spinning recommences, as the fastening strength of the fiber, wound onto the end part of the package side yarn end, is stronger than at times of normal spinning, a strong joint is formed at the pieced area. If air pressure for normal spinning is not resumed, as soon as possible after the joint has passed, the twist in the fastening fiber becomes too strong and a yarn of bad feeling touch may be produced.

Therefore the time for blowing high air pressure is set to a suitable value with regard to spinning speed, count of yarn and the like. It is possible to set this time by a control apparatus such as a sequencer.

An example of the measurement of this effectiveness will be explained using the comparison table below. This measurement effectiveness was carried out using a polyester-cotton T/C36 spun yarn. In Table 1, the success rate climbs from a previous 80% to 85–92%. The rate of generation of "slip out" falls from 50% to 0% and the maintenance rate of the yarn strength at the joint part to the normal part becomes 60–80% from a previous 0–70%.

TABLE 1

| | Previously | The Present Invention |
|---|---|---|
| Success Rate (%) | 80 | 85–92 |
| "Slip out" Generation Rate (%) | 50 | 0 |
| Yarn Strength Maintenance Rate | 0–70 | 60–80 |

As described above, the spinning apparatus of this invention uses a rotating air current from a predetermined air pressure to high air pressure at times of spinning recommencement and demonstrates the effectiveness whereby an increase in the piecing success rate and maintenance rate of the yarn strength can be attained by the application of a simple machine structure.

What is claimed is:

1. A method of spinning and piecing a yarn comprising the steps of:

providing a spinning and piecing apparatus having an air circuit which includes a first circuit portion that delivers air of a predetermined air pressure, a second circuit portion that delivers air of a pressure higher than said predetermined air pressure, and a change-over valve means for changing between said first circuit portion and said second circuit portion;

starting spinning by applying a rotating air current, at said predetermined air pressure, to a fiber bundle which has been supplied to a rotating air current application area in a spinning section of said spinning and piecing apparatus;

applying a twist to said fiber bundle, said fiber bundle having an opened and coreless construction, to form a spun yarn;

delivering said spun yarn to a spun yarn take-up section where said spun yarn is wound onto a package;

detecting breakage of said spun yarn at said package such that spinning ceases;

reversely threading said spun yarn that has broken to a package side yarn end of said spinning section into said rotating air current application area of said rotating air current of said spinning section to join said spun yarn, which has an end opened by an air sucker, to said fiber bundle in said rotating air current application area of said spinning section of said spinning and piecing apparatus;

recommencing spinning once said spun yarn and said fiber bundle are in said spinning section to piece said spun yarn and said fiber bundle to form a joint; and increasing said predetermined air pressure of said rotating air current to a high air pressure immediately upon recommencing spinning, wherein said high air pressure is higher than a normal air pressure used during conventional spinning and wherein said high air pressure is maintained for a period of time ranging from shortly before recommencing spinning to shortly after recommencing spinning;

piecing said spun yarn to said fiber bundle to form a high strength joint; and decreasing said high air pressure to said predetermined air pressure.

2. The method of spinning and piecing a yarn as in claim 1, further comprising commencing running of said package side yarn end, wherein said commencing running starts simultaneously with said step of recommencing spinning.

3. The method of spinning and piecing a yarn as in claim 1, further comprising the step of turning on a first air circuit supplying said predetermined air pressure prior to said step of decreasing said high pressure air by turning off a second air circuit supplying high air pressure.

4. An apparatus for spinning and piecing a yarn, said apparatus comprising:

a spinning section having means for forming a spun yarn from a fiber bundle including an air circuit means for applying a rotating air current at a predetermined air pressure to said fiber bundle, after said fiber bundle has been supplied to a rotating air current application area of said spinning section wherein a twist is applied to said fiber bundle, said fiber bundle having an opened and coreless construction, to form a spun yarn;

a spun yarn take-up section having a package, wherein said spun yarn from said spinning section is wound onto said package;

means for detecting breakage of said spun yarn at said package so that spinning ceases;

a piecing section wherein said spun yarn is reversely threaded into a package side yarn end of said spinning section and spinning is recommenced; and means for increasing said predetermined air pressure applied to said fiber bundle to a high air pressure after said fiber bundles have had said twist applied and after said recommencement of spinning and for a time period ranging from immediately before to immediately after said recommencement of spinning.

5. The apparatus for spinning and piecing as in claim 4, wherein said means for increasing said predetermined air pressure to said high pressure comprises a first air circuit which supplies said predetermined air pressure, a second air circuit which supplies said high air pressure, wherein said high air pressure is higher than a normal air pressure used during conventional spinning and including a change over means for changing said predetermined air pressure to said high air pressure and vice versa.

6. The apparatus for spinning and piecing as in claim 5, wherein said change-over means turns on said first air circuit prior to turning off said second air circuit.

* * * * *